US005270620A

United States Patent [19]

Basch et al.

[11] Patent Number: 5,270,620

[45] Date of Patent: Dec. 14, 1993

[54] HIGH FREQUENCY RESONANT CONVERTER FOR OPERATING METAL HALIDE LAMPS

[75] Inventors: John G. Basch, Westlake; Louis R. Nerone, Brecksville, both of Ohio

[73] Assignee: General Electric Company, Schenectady, N.Y.

[21] Appl. No.: 719,695

[22] Filed: Jun. 25, 1991

Related U.S. Application Data

[63] Continuation of Ser. No. 577,236, Sep. 4, 1990, abandoned.

[51] Int. Cl.[5] ..... H05B 41/36

[52] U.S. Cl. ..... 315/291; 315/82; 315/226; 315/287; 315/DIG. 5

[58] Field of Search ..... 315/291, 174, 82, 287, 315/DIG. 5, 226

[56] References Cited

U.S. PATENT DOCUMENTS

| | | | |
|---|---|---|---|
| 3,999,100 | 12/1976 | Dendy et al. | 315/291 |
| 4,039,897 | 8/1977 | Dragoset | 315/287 |
| 4,060,752 | 11/1977 | Walker | 315/DIG. 5 |
| 4,156,166 | 5/1979 | Shapiro et al. | 315/291 |
| 4,388,565 | 6/1983 | Rividi | 315/291 |
| 4,626,746 | 12/1986 | Zaderej | 315/287 |
| 4,862,042 | 8/1989 | Herrick | 315/291 |
| 4,937,501 | 6/1990 | Ganser et al. | 315/209 R |
| 4,999,547 | 3/1991 | Ottenstein | 315/287 |

*Primary Examiner*—Eugene R. LaRoche
*Assistant Examiner*—Son Dinh
*Attorney, Agent, or Firm*—George E. Hawranko; Stanley C. Corwin; Fred Jacob

[57] ABSTRACT

A method and a ballast circuit are disclosed for operating a metal halide lamp particularly suited for horizontal applications that provides signals capable of being varied so as to control the power applied to the metal halide lamp while still providing a uniform arc. The ballast circuit has a filter which passes a selected band of frequencies for the operating signals of the metal halide lamp.

14 Claims, 5 Drawing Sheets

Fig. 3(a)
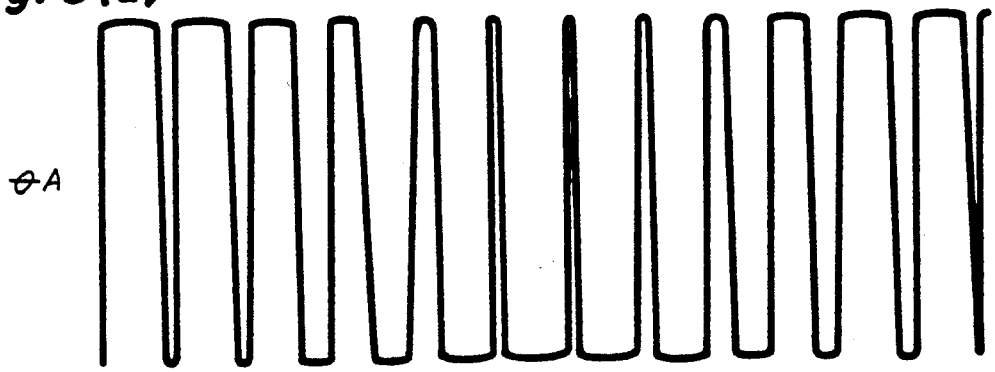
Fig. 3(b)
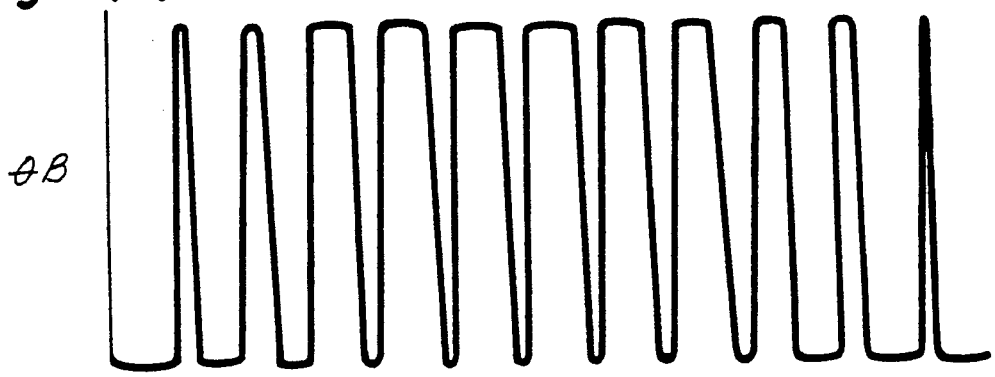
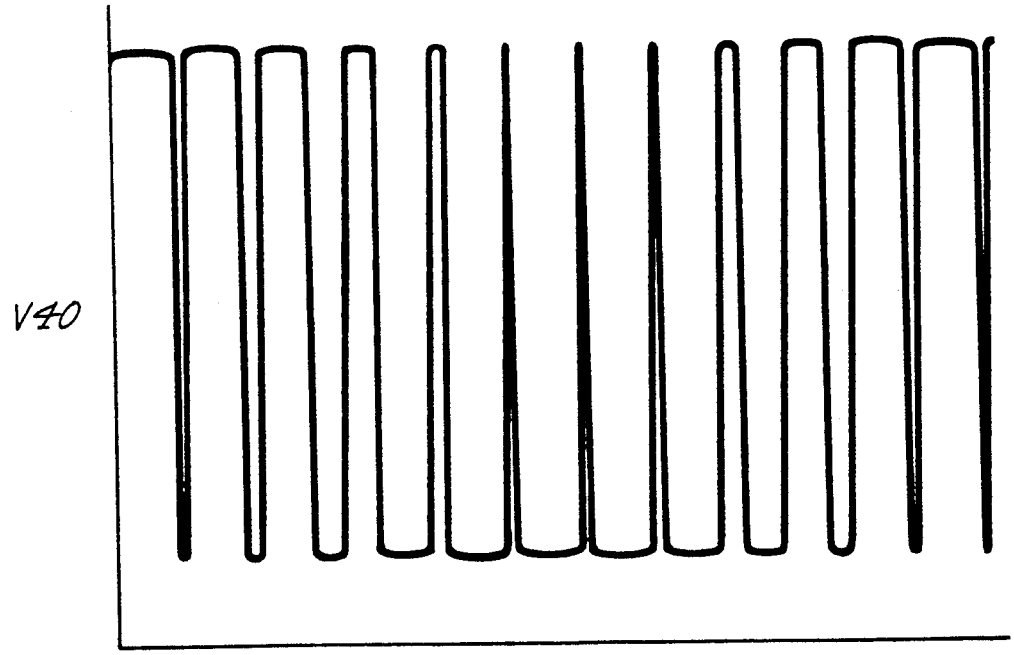
Fig. 3(c)

HIGH FREQUENCY RESONANT CONVERTER FOR OPERATING METAL HALIDE LAMPS

This application is a continuation, of application Ser. No. 577,236, filed Sep. 4, 1990 now abandoned.

BACKGROUND OF THE INVENTION

This invention relates to a method and an operating circuit for a gas discharge lamp. More particularly, the invention relates to a method and a ballast circuit each of which provides a signal having a selected band of frequencies for operating a xenon-metal halide lamp that is particularly suited for vehicle applications.

U.S. patent application Ser. No. 157,436 filed Feb. 18, 1988 of R. S. Bergman et al. assigned to the same assignee as the present invention and herein incorporated by reference, discloses a xenon-metal halide lamp particularly suited for automotive applications. The xenon-metal halide lamp provides improved efficiency and longer life relative to incandescent lamps while a high pressure xenon gas within the lamp primarily achieves instant light capabilities which makes such a lamp particularly suited for vehicle applications.

U.S. patent application Ser. No. 320,736 filed Mar. 8, 1989 of G. R. Allen et al. discloses a method and a circuit for acoustically operating a xenon-metal halide lamp during its various modes within selected bands of frequencies and allowing such a lamp to be operated in a horizontal orientation that is particularly suited for vehicle applications. U.S. patent application Ser. No. 320,736 teaches a method and ballast that reduces the arc bowing typically experienced by a high pressure xenon-metal halide lamp and also allows for a high pressure xenon-metal halide lamp to serve as a source of light for both high and low beam illumination patterns for the vehicle.

The ballast of U.S. application Ser. No. 320,736 serves well the needs of the metal halide discharge lamp but has somewhat of a limitation in that it does not disclose the means for adjusting the power that may be applied to the xenon metal halide lamp for regulation purposes. For example, it is desired to reduce the power applied to the lamp by a factor of approximately 3–4 from its initial start mode of operation to its final or run mode of operation. Such a reduction should be accomplished without varying the desired operating frequency of the signal applied to the lamp so that the arc within the lamp is not bowed significantly.

Accordingly, it is an object of the present invention to provide an AC ballast circuit that allows the power applied to the lamp to be decreased from its start mode value to its desired value occurring during its run mode of operation without varying the desired operating frequency so as to regulate the power to the metal halide lamp while still yielding a non-bowed arc condition.

It is a further object of the present invention to provide a ballast circuit that provides desired signals for operating the metal halide lamp in a horizontal orientation which is particularly suited for vehicle applications.

SUMMARY OF THE INVENTION

The present invention is directed to a ballast circuit and a method for operating a xenon-metal halide lamp which is particularly suited for vehicle applications and allows for variations in the power applied to such lamps without changing the frequency of the applied signal so as to accommodate the various modes of the lamp's operation while still providing a non-bowed arc condition.

The circuit for operating the xenon-metal halide lamp comprises means for generating a sinusoidal waveform, means for generating a triangular waveform, means for receiving and comparing the sinusoidal and triangular waveforms against each other and developing in response thereto varying rectangular pulses which are routed to filtering means. The sinusoidal waveform has a predetermined amplitude and a varying frequency within a range from about 39 kHz to about 68 kHz. The triangular waveform has a variable amplitude and a frequency of about 635 kHz. The filtering means passes a band of frequencies of said sinusoidal varying rectangular pulses in the range of about 39 kHz to about 68 kHz. The invention selects the component values of the filtering means so that the majority of the frequencies passed thereby provides for operating the lamp in a stable manner with little or no arc bowing.

BRIEF DESCRIPTION OF THE DRAWINGS

FIG. 2(*a*) illustrates a variable frequency (fixed amplitude) sine-wave signal and a variable amplitude (fixed frequency) sawtooth signal both of which cooperate in the development of signal V40 of FIG. 2(*b*) having a variable rectangular pulse shape.

FIG. 3 consists of FIG. 3(*a*), 3(*b*) and 3(*c*). FIG. 3(*a*) and (*b*) respectively illustrate signals $\theta_A$ and $\theta_B$ which cooperate in the development or signal $V_{40}$ shown in FIG. 3 (*c*).

DETAILED DESCRIPTION OF THE PREFERRED BALLAST EMBODIMENTS

Figure 1:
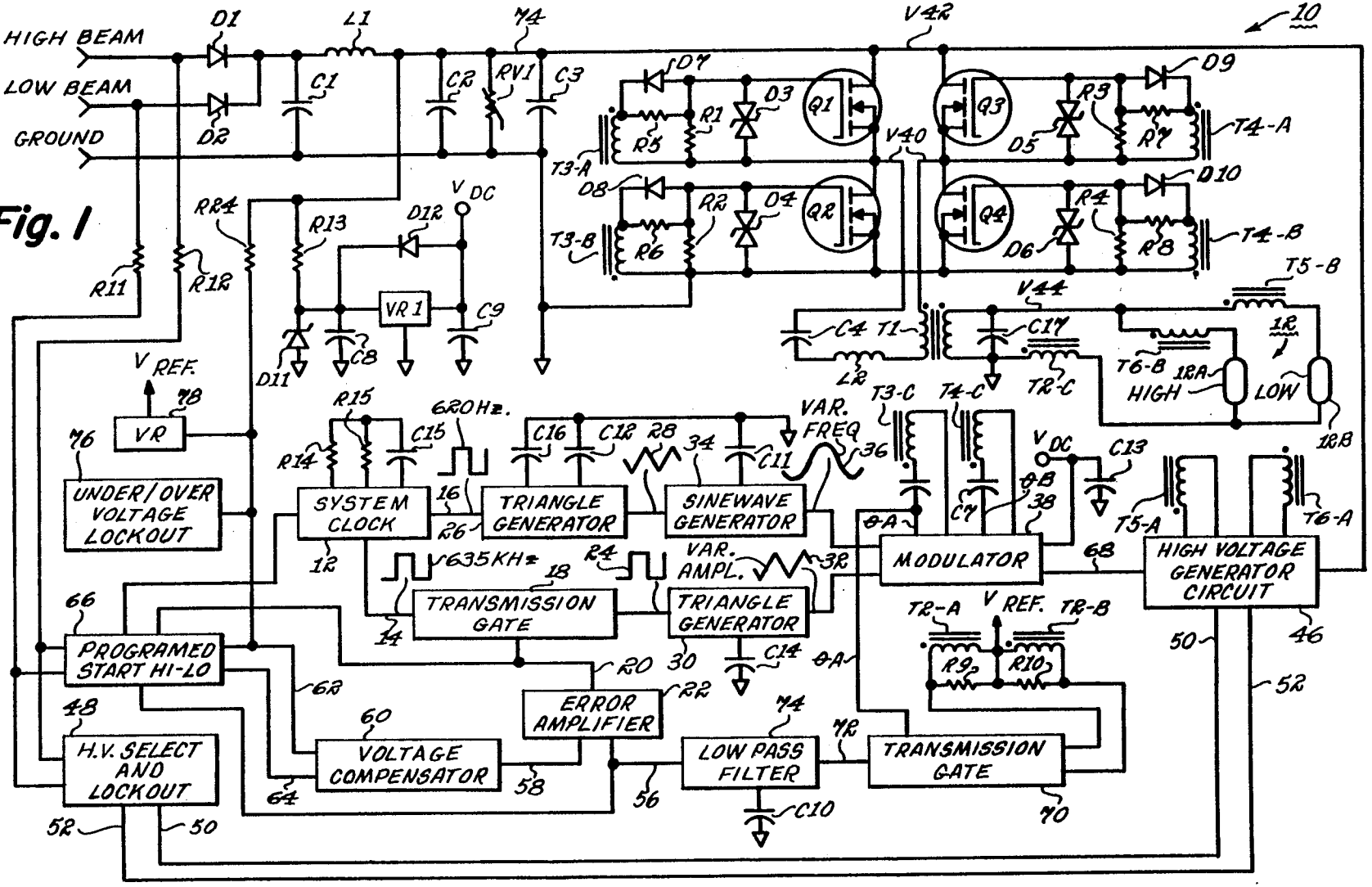
FIG. 1 is a block diagram illustrating a preferred embodiment of the present invention.

A schematic diagram of a preferred embodiment of the present invention is illustrated in FIG. 1 for an operating circuit 10 that provides for the desired signals for operating one or more sources of light 12 such as those used for an automotive headlamp shown as a high beam source 12A and a low beam source 12B. The circuit arrangement 10 is comprised of various circuit networks having a reference number, and of a typical component value or a type supplied by typical manufacturer all of which are given in Table 1.

| Reference Number | Circuit Function | Typical Type Value | Typical Manufacturer |
|---|---|---|---|
| D1 | Diode | MR754 | Motorola |
| D2 | Diode | MR754 | Motorola |
| D3 | Transzorb | SA12CA | Gen Semicond |
| D4 | Transzorb | SA12CA | Gen Semicond |
| D5 | Transzorb | SA12CA | Gen Semicond |
| D6 | Transzorb | SA12CA | Gen Semicond |
| D7 | Diode | 1N5817 | Motorola |
| D8 | Diode | 1N5817 | Motorola |
| D9 | Diode | 1N5817 | Motorola |
| D10 | Diode | 1N5817 | Motorola |
| D11 | Diode | 1N5256 | Motorola |
| D12 | Diode | 1N4001 | Motorola |
| C1 | Capacitor | 0.47UF | Panasonic |

-continued

| Reference Number | Circuit Function | Typical Type Value | Typical Manufacturer |
|---|---|---|---|
| C2 | Capacitor | 3300UF | Sprague |
| C3 | Capacitor | 1UF | Panasonic |
| C4 | Capacitor | 7.0UF | Elect. Concpts |
| C5 | Capacitor | 4.7UF | Panasonic |
| C6 | Capacitor | 0.33UF | Panasonic |
| C7 | Capacitor | 0.33UF | Panasonic |
| C8 | Capacitor | 0.47UF | Panasonic |
| C9 | Capacitor | 4.7UF | Panasonic |
| C10 | Capacitor | 0.0033UF | Panasonic |
| C11 | Capacitor | 470PF | Panasonic |
| C12 | Capacitor | 0.82UF | Panasonic |
| C13 | Capacitor | 4.7UF | Panasonic |
| C14 | Capacitor | 820PF | Panasonic |
| C15 | Capacitor | 470PF | Panasonic |
| C16 | Capacitor | 0.01UF | Panasonic |
| C17 | Capacitor | 0.07UF | Panasonic |
| R1 | Resistor | 10K OHMS | Film |
| R2 | Resistor | 10K OHMS | Film |
| R3 | Resistor | 10K OHMS | Film |
| R4 | Resistor | 10K OHMS | Film |
| R5 | Resistor | 10 OHMS | Film |
| R6 | Resistor | 10 OHMS | Film |
| R7 | Resistor | 10 OHMS | Film |
| R8 | Resistor | 10 OHMS | Film |
| R9 | Resistor | 10 OHMS | Film |
| R10 | Resistor | 10 OHMS | Film |
| R11 | Resistor | 49.9K OHMS | Film |
| R12 | Resistor | 49.9K OHMS | Film |
| R13 | Resistor | 1.0 OHM | Film |
| R14 | Resistor | 7.32K OHMS | Film |
| R15 | Resistor | 1.47K OHMS | Film |
| R16 | Resistor | 10K OHMS | Film |
| R17 | Resistor | 10K OHMS | Film |
| Q1 | Mosfet | IRFZ-34 | Int Rect |
| Q2 | Mosfet | IRFZ-34 | Int Rect |
| Q3 | Mosfet | IRFZ-34 | Int Rect |
| Q4 | Mosfet | IRFZ-34 | Int Rect |
| VR1 | Regulator | MC7805BT | Motorola |
| RV1 | MOV | 24 Volt | Gen Elect |
| T1 | Transformer | Power-1:7 Ratio | Ferroxcube |
| T2 | Transformer | Current-12.1:1 Ratio | TDK |
| T3 | Transformer | Gate-1:1.33 Ratio | TDK |
| T4 | Transformer | Gate-1:1.33 Ratio | TDK |
| T5 | Transformer | HV Drive 1:136.4 Ratio | Ferroxcube |
| T6 | Auto XFMR | High Voltage 3:30 Ratio | Fair-Rite |
| T7 | Auto XFMR | High Voltage | Fair-Rite |
| L1 | Inductor | EMI - 4.0 UH | Siemens |
| L2 | Inductor | Resonant - 2.6 UH | Ferroxcube |

The gas discharge lamp 12A and 12B may each be a high pressure discharge type devoid of a filament such as that disclosed in either U.S. patent application Ser. Nos. 157,360; 157,359; 157,436; or 266,129 all assigned to the same assignee as the present invention, and all herein incorporated by reference. All of these metal halide discharge lamps provide for instant light capabilities which is particularly suited for automotive or vehicle applications. Further, the gas discharge lamps, 12A and 12B, may also be other discharge lamps for lighting applications other than automotive.

The metal halide discharge lamps related to the present invention commonly operate in two modes which are; (1) a cold or starting mode in which a relatively high value of a starting voltage is necessary to be applied across the electrodes of the lamp so as to first place the gases within the lamp in a suitable ionization condition to allow striking or initiating a discharge condition; and (2) a steady state or run mode in which the arc discharge of the lamp generates a desired light output at a relatively low or moderate voltage which occurs between the electrodes of the lamp.

In general, the circuit arrangement 10 provides an AC ballast circuit that allows the power that is applied to the gas discharge lamp, such as the metal halide lamp, to be varied from an initial relatively high value during the start mode of the lamp to a substantially reduced value occurring during the run mode of operation of the lamp. The reduction in power between the modes may be by a factor of 3–4. The arc of the metal halide lamp is maintained in a relatively straight manner by the selection of a desired frequency for the excitation signal of the lamp as more fully disclosed in the previously mentioned U.S. patent application Ser. No. 320,736. The reduction of the power for an arc straightened lamp of the present invention is accomplished without varying the desired frequency of the signal for operating the lamp, so as to regulate the power to the metal halide lamp while still yielding stable and substantially non-bowed arc condition.

The ballast circuit 10 comprises a system clock 13 that generates a first clock signal 14 of a rectangular shape and a second clock signal 16 of a rectangular shape respectively having predetermined frequencies of 635 kHz and 620 Hz. The first clock signal 14 is routed to and accepted by transmission gate means 18 at its first input which gate has as its second input an error reference signal 20 developed by error amplifier 22. The transmission gate 18 in response to its first and second inputs develops a square-wave signal 24 having a variable amplitude which is dependent upon the amplitude of the error amplifier 22, whose frequency is fixed and based on clock signal 14.

The AC ballast circuit 10 further comprises a first triangle generator 26 which accepts the second clock signal 16 and generates in response thereto a first triangle waveform 28 having the same frequency as the second clock signal 16. A second triangle generator 30 accepts the square-wave signal 24 and generates in response thereto a triangular signal 32 having a variable amplitude with a frequency corresponding to the signal 24.

A sinewave generator 34 accepts the first triangular signal 28 and generates, in response thereto, a sinewave signal 36 of a variable frequency dependent upon the amplitude of the applied signal 28. The typical frequency of 36 is between 39 kHz and 68 kHz. Signal 36 is applied to a phase modulator 38 having as its second input the triangular waveform 32. The variable frequency of signal 36 primarily provides for acoustic straightening of the arc of the lamp, whereas, the variable amplitude of signal 32 primarily provides for adjusting the operating power of lamp 12.

In general, the phase modulator 38 operates as a comparator and drive circuit for controlling the full bridge comprised of the elements of Table 2 all arranged as shown in FIG. 1.

TABLE 2

| FULL BRIDGE CONVERTER Elements |
|---|
| Transformers T3 and T4 |
| Capacitors C6 and C7 |
| Resistors R1, R2, R3, R4, R5, R6, R7 and R8 |
| Transistors Q1, Q2, Q3, and Q4; and |
| Diodes D3, D4, D5, D6, D7, D8, D9 and D10 |

Figure 2A:
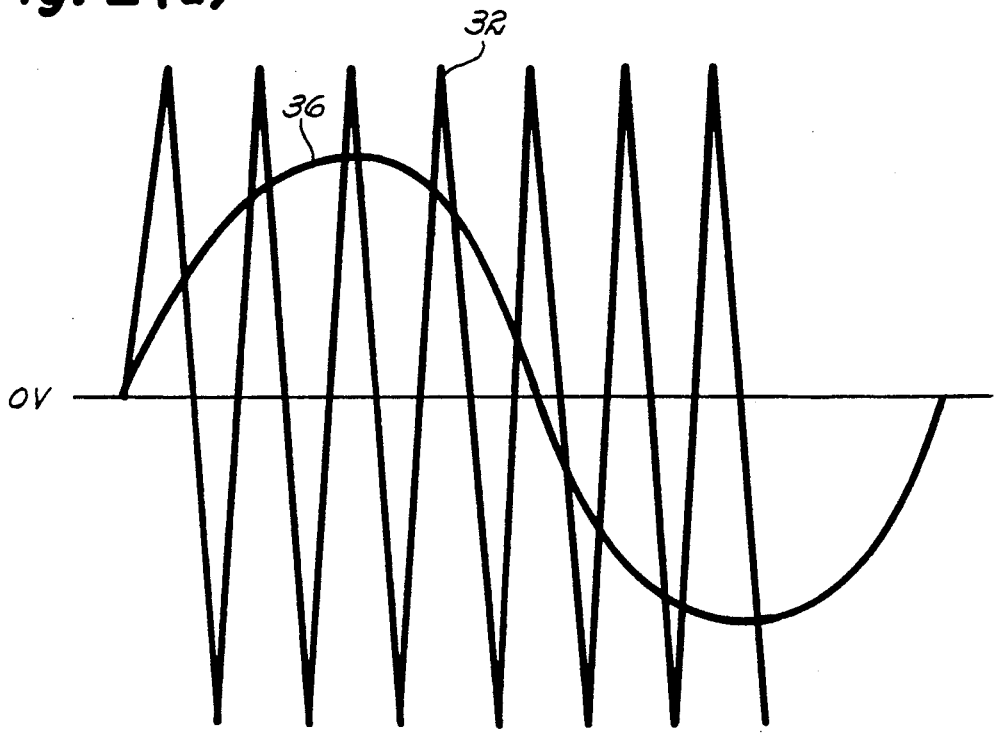
FIG. 2 consists of FIG. 2(*a*) and FIG. 2(*b*).
Figure 2B:
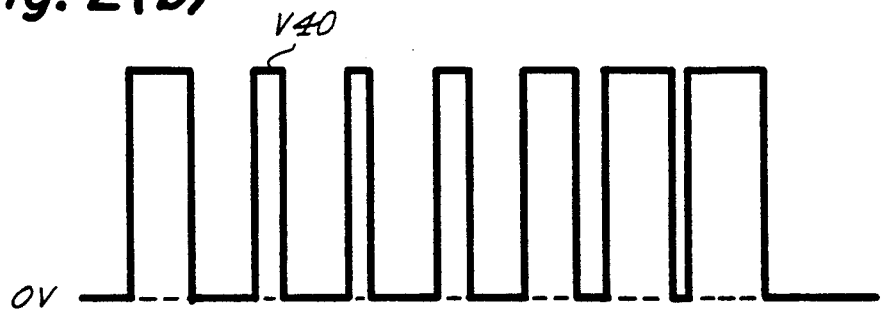

The operation of the full bridge converter which is controlled by the phase modulator 38 is illustrated in FIG. 2 comprised of FIG. 2(*a*) illustrating the interrelationship between signals 32 and 36, and FIG. 2(*b*) which illustrates signal V40 which is the output of the full bridge. The signals 32 and 36 are applied to the phase modulator 38 which, in cooperation with the full bridge, acts as a comparator to generate an output signal V40 shown in FIG. 2(*b*) as having pulsed rectangular shape with variable on-off times. The phase modulator 38 treats the sinewave signal 36 as a carrier wave and treats the triangular waveform 32 as a signal for modulating signal 36. The phase modulator 38, in response to these two signals 32 and 36, generates; (*1*) a first signal $\theta_A$, shown on FIG. 3(*a*) representative of a sinusoidal approximated pulse width modulated signal, and (2) a second signal $\theta_B$, shown on FIG. 3(*b*), representative of a sinusoidal approximated pulse width modulated signal exactly opposite to $\theta_A$. The output $V_{40}$ of the full bridge converter of Table 2 is shown on FIG. 3(*c*). The output of the modulator 38 is coupled to two inputs of the full bridge network of Table 2 by means of a transformer T3 and T4 having polarities as indicated by dots. The transformers primary windings T3-C and T4-C have signals $\theta_A$ and $\theta_B$ imposed upon them respectively. The signal $\theta_A$ is coupled to the windings T3-A and T3-B, and the signal $\theta_B$ is coupled to the windings T4-A and T4-B. The signals $\theta_A$ and $\theta_B$ are routed to the bridge network of Table 2 which has a signal $V_{42}$ present at the drain of each of the transistors Q1 and Q3. The output signal $V_{40}$ of the full bridge converter is present across the drain of each of the transistors Q2 and Q4.

In general, the full bridge of Table 2 operates such as a full bridge inverter, whose switching frequency is dependent upon the drive signals from $\theta_A$ and $\theta_B$. $\theta_A$ controls one half side of the full bridge, and $\theta_B$ controls the other half. Thus, when phased properly, simultaneous conduction between the power switches is minimized. The full bridge develops the signal $V_{40}$ which is a rectangular waveform having a pulse width dependent on the amplitude of the triangle waveform 32. The signal $V_{40}$ is routed to a transformer and band pass filter comprised of $T_1$, $L_2$, C4 and C17 as shown in FIG. 1. As the amplitude of the triangle signal 32 increases, the RMS output voltage of the pass band filter decreases.

The network C4, L2 and C17 and L2 provides a band-pass filter for passing a predetermined frequency band of the drive signal onto the light source 12. The predetermined frequency band is in the range from about 39 kHz to about 68 kHz. The operation of the band pass filter along with the related circuit may be further described with reference of FIG. 4.

Figure 4:
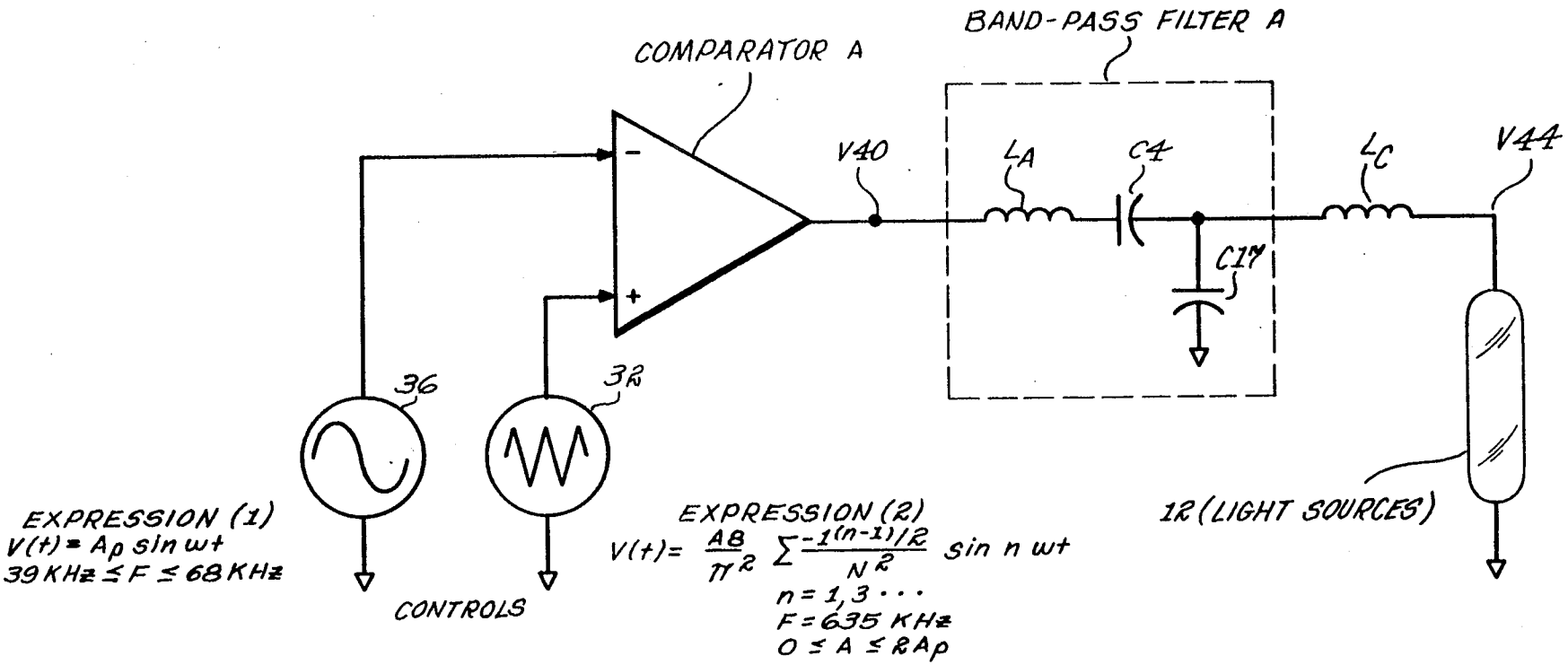
FIG. 4 is a simplified diagram illustrating the primary functional elements related to the present invention.
Figure 5:
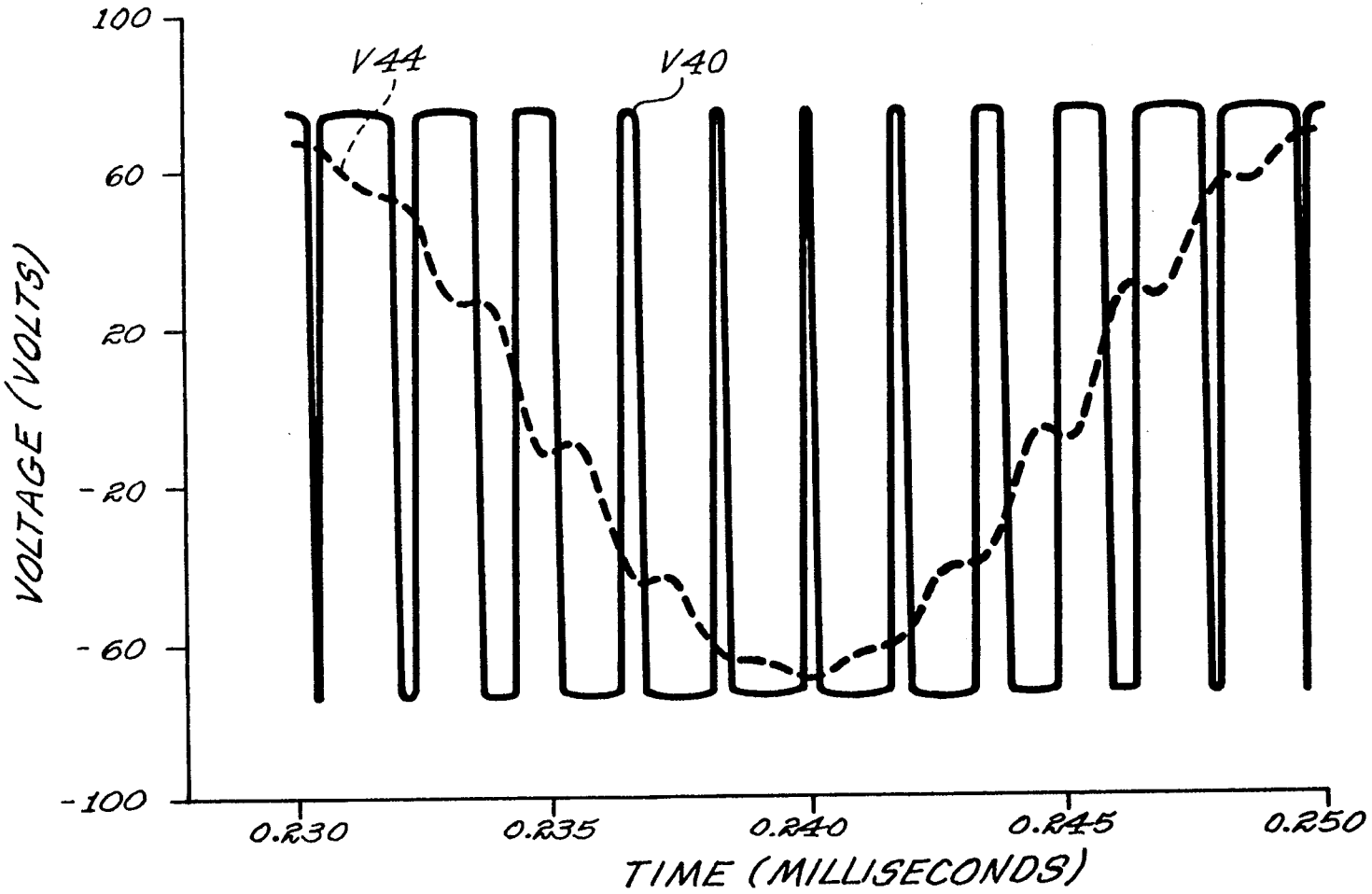
FIG. 5 is a diagram illustrating the interrelationship between the rectangular varying pulses V40 and the sinusoidal signal V44 both related to the present invention.

FIG. 4 is a simplified diagram illustrating the basic principles of the present invention and from which computer simulation results shown on FIG. 5 were obtained. FIG. 4 shows the sinewave 36 signal, given by the shown expression (1), and the triangular wave shape 32 given by the shown expression (2). The signal 36 has a desired frequency range from greater than about 39 kHz to less than about 68 kHz, whereas, signal 32 has a desired frequency of about 635 kHz. Signal 36 has an amplitude $A_p$, whereas, signal 64 has an amplitude of $A8/\pi^2$ where $A \geqq 0$ but $\leqq 2A_p$. The signals 36 and 32 of FIG. 4 are shown as being routed respectively to the (+) and (−) inputs of a comparator A. The circuit function being performed by comparator A of FIG. 3 includes the operation of the phase modulator 38 and the full bridge converter of Table 2. The comparator A develops the sinusoidal varying rectangular pulses V40 in response to the instantaneous difference in the coincidence between signal 36 and 32 and which output signal is routed to a band-pass filter A. Band-pass filter A is comprised of components LA, C4, and C17. The component LA includes the leakage inductance of T1 and the inductance of inductor L2. The component LA, C4 and C17 each have a range of values as given in Table 3.

TABLE 3

| Component | Range of Values |
|---|---|
| LA | 140 u henries to 160 u henries |
| C4 | 0.05 ufd. to 0.08 ufd. |
| C17 | 0.005 ufd. to 0.008 ufd. |

The band-pass filter A passes a band of frequencies in the range from about 39 kHz to about 68 kHz. The output of the band-pass filter A is routed to a high voltage coil LC which is the total inductance of winding T2-C and has a typical value of 13 u henries. The output of LC shown as output $V_{44}$ is routed to the metal halide lamp 12 having a very high cold, initial starting mode impedance and a typical impedance of 63 ohms indicative of its hot or run mode state.

The arrangement of FIG. 4 having its shown parameters, formed the basis of a computer model from which computer simulations were performed. For such a model, the signal 36 of expression (1) was varied from a frequency 39.5 kHz to 67.5 kHz with $A_p$ amplitude having a value of about 1 volt, while at the same time, the signal 32 of expression (2) was assigned a frequency of 635 kHz and its amplitude was varied from $\geqq 0$ to $\leqq 2A_p$, where $2A_p$ was given a value equal to about 3 volts. The results of such computer simulations are shown in FIG. 5.

FIG. 5 shows the two interrelated signals V40 and V44 plotted against a X coordinate of time given in milliseconds and a Y coordinate of voltage given in volts. The signal V40 varies from about +75 volts to about −75 volts, whereas, the signal V44 varies from about +70 volts to about −70 volts. Both of the signals V40 and V44 repeat after about 20 microseconds (0.250 ms–0.230 ms).

From FIG. 5 it is seen that the occurrence of the minimum pulse width of signal V40 corresponds to the occurrence of the minimum amplitude of signal V44. The pulse width of signal V40 may be selected by choosing the parameters of signals 32 and 36 so as to correspondingly cause a predetermined amplitude for the signal V44. The pulse width and the amplitude for signals V40 and V44, respectively, may be selected so as to provide for various power levels to be applied to the metal halide lamp during the start and run modes of its operation. Table 4 shows corresponding values of the magnitude of V44 at 52 kHz desired to operate the lamps 12A and 12B.

TABLE 4

| Mode | V40 | V44 | Power In Watts |
|---|---|---|---|
| START | 43 Vrms | 15 Vrms | 55 |
| RUN | 43 Vrms | 40 Vrms | 25.4 |

In the practice of the present invention a xenon-metal halide lamp was oriented in a horizontal manner for its operation with the RMS voltages selected from Table 4. The metal halide lamp 12 was sequenced from its start to its run mode of operation and the horizontally oriented lamp operated in a successful manner yielding a desired minimally bowed arc. For such an operation the power supplied to the lamp 12 was 55 watts during its start mode and then reduced by a factor of about 2.2 to 25.4 watts during its run mode.

The present invention contemplates that the metal halide lamp 12 may be operated in a prescribed manner comprising the steps of at least (a) supplying a sinusoidal signal having a predetermined amplitude and a frequency within a predetermined range of about 39 kHz to about 67 kHz; (b) supplying a triangular signal having a predetermined amplitude and a frequency of about 635 kHz; (c) providing means for receiving and comparing the sinusoidal and triangular signals to each other and in response thereto developing varying rectangular pulses representative of the coincidence between the sinusoidal and the triangular signals; and finally (d) providing means for receiving and filtering the sinusoidal varying rectangular pulses with the filtering means passing a band of frequencies of the sinusoidal varying rectangular pulses in the range from about 39 kHz to about 67 kHz for operating the metal halide lamp.

As will be more fully disclosed, the contemplated method may further comprises; (a) providing means for detecting the amount of the average current within the sinusoidal signal imposed on the metal halide lamp; (b) providing means for establishing a reference signal indicative of the amount of power desired to be applied to the gas discharge lamp 12 and, finally, (c) providing means for developing a reference error signal indicative of the difference between the reference signal and the average current within the sinusoidal signal imposed on the metal halide lamp.

It should now be appreciated that the practice of the present invention provides for a method and a ballast circuit that allows the power to be applied to the metal halide lamp to be decreased from a relatively high value occurring at the start mode of operation of the lamp to a relatively low value occurring during the run mode of operation of the lamp. The reduction in power is accomplished without varying the desired operating frequency so as to regulate power of the metal halide lamp while still yielding a uniform arc.

The ballast circuit 10 of the present invention comprises further desirable features such as supplying the starting voltage for the metal halide lamp and may be described with reference to FIG. 1. For the embodiment shown in FIG. 1, the ballast circuit 10 operates two metal halide lamps 12A and 12B serving as the high beam and low beam illumination respectively. The ballast circuit 10 is equally applicable to the operation of less than two or more than two metal halide lamps so long as the approximate ballast circuit 10 additions or deletions are accomplished.

A high voltage generator circuit 46 of ballast 10 provides the starting voltage for both the high and low beam light source. The circuit 46 is interconnected to the low beam light source 12B by means of transformer windings T5-A and T5-B, whereas, the circuit 46 is interconnected to the high beam light source 12A by means of transformer windings T6A and T6B. The determination of which light source (high or low) is controlled by the HV select and lockout network 48.

The (HV) select and lockout network 48 senses for the HIGH or LOW BEAM occurrences from the related automotive network to turn-on to the high voltage generator circuit 46. The circuit 48 in response to either the HIGH or LOW beam input generates respective command signals 50 or 52 which are both routed to the high voltage generator 46. The high voltage generator in response to the command signals 50 or 52 generates high voltage pulses having a predetermined amplitude such as 20 KV and a predetermined frequency of approximately 5 MHz. These signals are applied to the light source 12A or 12B to initially ionize its internal gases and to render it operative. Upon the initiation of the ionization the high voltage generator is preferentially removed from the circuit by the action of (HV) select and lockout network 48.

A further feature of the present invention provides for the previously mentioned error reference signal 20 that allows for automatically maintaining the predetermined power level applied to the light source 12A or 12B during their operation. The error reference signal 20 is developed by error amplifier 22 having as its first or negative (−) input a signal 56 herein termed "error signal" and as its second or positive (+) input a signal 58 herein termed "reference signal". The error reference signal 54 is generated to compensate and correct for differences occurring between the two inputs.

The reference signal 58 is developed by a voltage compensator network 60 having (1) an input signal 62 applied to its negative input which serves as reference for the compensator network and (2) a second signal which is a programmed signal 64 generated by programmed start HI and LO network 66 that is applied to its positive input and representative of the desired power level to which the light source is to be maintained. When a high signal (HIGH BEAM) is energized, the network 66 detects this and produces a voltage on signal 64 to control the power into the high beam lamp. The voltage signal 64 remains constant for a specified time when the voltage on signal (HIGH BEAM input) goes high, then after this period exponentially decays to its final voltage value. This "dwell time" and "ramp time" is selected so as to produce relative constant light output from the high beam. This implies that the "dwell time" period produces approximately 55 watts at start and ramps down exponentially to 25 watts at run. The response and operation of circuit 66 is substantially the same when a LOW BEAM input command from the automotive system is sensed.

The error signal 56 is first developed by means such as transformer T2 which is interposed between common ground and the light sources 12A and 12B. Signal V44 is routed to the lamps 12A and 12B in response to turn-on command from the HIGH BEAM or LOW BEAM input. This allows the signal generated by high voltage generator 46 to be routed to the selected lamp 12A or 12B. The transformers T5 and T6, with polarities indicated by the shown dots, have a primary winding T5-A and T6-A, respectively, that develop a signal which is respectively coupled to secondary windings T5-B and T6-B. The presence or absence of the signals developed by the transformers T5 and T6 is controlled by signal 68 generated by modulator 38 in a similar way as described for signals $\theta_A$ and $\theta_B$.

The transformer T2 provides a signal 72, by way of transmission gate 70, to the low pass filter 74 representative of the amount of lamp current driven through the primary of the current transformer T2. The low pass filter 74 in response to signal 72 develops the reference signal 56. The low pass filter 48 has a breakpoint frequency of about 4.88 kHz which is approximately the geometric mean between 620 Hz and 40 kHz.

A further feature of the present invention is the filtering of electromagnetic interference (EMI) that may be present in the line current. The EMI filtering is accomplished by L1, C1, and C2 so as to substantially remove the electromagnetic interference component that may be present in signal 74. The signal 74 is routed to the energy storage device C3, having a value in the range from 0.2 to 4 mfd, which accepts and stores energy from the signals HIGH BEAM or LOW BEAM from the automotive system so that if line transients occur, the voltage signal V42 remains relatively constant.

Still further, the ballast circuit 10 preferably includes an under/over voltage lockout network 76. The network 76 operates such that when voltages of HIGH BEAM or LOW BEAM are between the undervoltage and overvoltage range, the ballast circuit 10 is enabled and will start and operate the lamp. However, if the voltage is on either voltage extreme, i.e., below the undervoltage or above the overvoltage, the control circuitry will not allow the ballast to start or operate either of the lamps 12A and 12B.

Further still, a VR network 78 is preferably included in the ballast circuit 10. This network 78 supplies the control IC voltages necessary for proper operation. Typically, Vcc is a regulated 10 volt DC signal to energize the control circuitry integrated circuits, while Vr is a regulated 5 volt DC signal used as a reference for the analog circuits in the control circuitry.

It should now be appreciated that the practice of the present invention provides for a ballast circuit in which the selected power level for the xenon-metal halide lamp is automatically maintained. Further, the present invention provides for EMI filtering and for a energy storage device which cooperates in the development of the high voltage signal to initiate the ionization of the metal halide lamp.

What we claim as new and desire to secure by Letters Patent of the United States is:

1. A ballast circuit for gas discharge lamps comprising;

A. Means for generating a sinusoidally approximated signal having a predetermined amplitude and a frequency within a predetermined range of values;

B. means for generating a second signal having a predetermined amplitude and a frequency substantially greater than the frequency of said sinusoidal signal generating means;

C. means for receiving and comparing said sinusoidal and second signals to each other and in response thereto developing varying rectangular pulses representative of the coincidence between said sinusoidal and said second signals; and D. means for receiving and filtering said varying rectangular pulses, said filtering means passing a band of frequencies of said varying rectangular pulses in the range from abut 39 kHz to about 68 kHz for operating said gas discharge lamps.

2. A ballast circuit according to claim 1 wherein;

A. said amplitude of said sinusoidal signal is in the range from about 15 to about 40 volts RMS and said predetermined range of frequency values is approximately from 39 kHz to approximately 68 kHz; and B. said second signal is triangularly shaped and has an amplitude in the range from about 40 to about 60 volts RMS.

3. A ballast circuit for a gas discharge lamp comprising;

A. clock means for generating a first and a second clock signal having a first and a second predetermined frequency;

B. transmission gate means for accepting; (1) said first clock signal and (2) an error reference signal, and in response to said first clock signal and said error reference signal generating a square-wave representative of the difference between these two signals;

C. a first signal generator for accepting said second clock signal and generating in response thereto a first signal having the same frequency as said second clock signal;

D. a second signal generator for accepting said square-wave signal and generating in response thereto a second signal;

E. a sinewave generator accepting said first signal and generating in response thereto a second sinewave signal having the same frequency as said first signal;

F. a phase modulator means for accepting; (1) said second sinewave signal serving as a carrier, and (2) said second signal serving as a modulating signal the carrier, said phase modulator means generating in response thereto (1) a first signal $\theta_A$ and (2) a second signal $\theta_B$ both representative of sinusoidally varying pulse width signals;

G. a power converter having means for accepting said first signal $\theta_A$, said second signal $\theta_B$ and a third signal representing the source of power for exciting such gas discharge lamp, said power converter generating a drive signal composed from said first signal $\theta_A$, said second signal $\theta_B$ and said third signal; and H. transformer and band-pass filter means for accepting said drive signal and passing a predetermined frequency band of said drive signal onto and for operating said gas discharge lamp.

4. A ballast circuit according to claim 3 further comprising;

A. means for sensing the occurrence of a high beam or a low beam signal from an external source and in response thereto generating a high voltage command signal; and B. means responsive to said high voltage command signal for generating high voltage pulses having a predetermined amplitude and a pulse width, said means for generating high voltage pulses being arranged in series with the band-pass filter and lamp.

5. A ballast circuit according to claim 3 wherein said error reference signal is developed by means comprising;

A. means for establishing a reference signal;

B. means for detecting the amount of the current flowing in said lamp and means for generating in response thereto an error signal, and C. means for detecting the difference between said reference signal and said error signal and generating in response thereto said error reference signal.

6. A ballast circuit according to claim 5 further comprising;

a low pass filter with the breakpoint frequency of 4.88 kHz which is approximately the geometric mean between 620 Hz and 40 kHz.

7. A ballast circuit according to claim 5 wherein said means for detecting the amount of current flowing in said lamp and means for generating in response thereto comprises;

A. a center-tapped transformer having a primary winding arranged in a serial manner with said gas discharge lamp and a first and a second secondary winding each having a resistive element connected across its winding; and B. transmission gate means having, (1) a first input that is developed across said first and second secondary windings and (2) a second input having said phase $\theta_A$ signal present, said transmission gate means generating said error signal in response to the coincidence between its first and second inputs.

8. A ballast circuit according to claim 4 further comprising;

A. an electromagnetic interference (EMI) filter accepting said high and low beam command signals and developing an EMI output signal;

B. an energy storage device comprised of a capacitor having a value in the range from about 0.2 mfd. to about 4 mfd., said energy storage device accepting and storing said EMI output signal and then allowing the stored signal to decay in response to transients in said high or low beam command signal.

9. A ballast circuit according to claim 5 wherein said means for establishing a reference signal comprises;

A. a network having (1) one set of inputs for receiving a high or low command signal respectively indicative of a command to energize high or low beam illumination, and (2) one of its other inputs for receiving a signal representative of the power to be applied to said gas discharge lamp, said network generating a reference signal in response to the difference between its inputs.

10. A ballast circuit according to claim 3 further comprising;

A. means for sensing the level of a high and low command signals and in response thereto generating an output signal to disable said drive signal if said level signal exceeds a predetermined value.

11. A method of operating a gas discharge lamp comprising the steps of;

A. supplying a sinusoidal signal having a predetermined amplitude and a frequency within a predetermined amplitude and a frequency within a predetermined range of about 39 kHz to about 68 kHz;

B. supplying a second signal having a predetermined amplitude and a frequency substantially greater than the frequency developed under said sinusoidal signal supplying step;

C. providing means for receiving and comparing said sinusoidal and second signals to each other and in response thereto developing sinusoidal varying rectangular pulses representative of the coincidence between said sinusoidal and said second signals; and D. providing means for receiving and filtering said sinusoidal varying rectangular pulses, said filtering means passing a band of frequencies of said sinusoidal varying rectangular pulses in the range from about 39 kHz to about 68 kHz for operating said gas discharge lamps.

12. A method according to claim 11 further comprising;

providing means for detecting the amount of average current within the sinusoidal signal imposed on the discharge lamp;

providing means for establishing a reference signal indicative of the amount of power desired to be applied to said gas discharge lamp; and providing means for developing a reference error signal indicative of the difference between said reference signal and said average current imposed within the sinusoidal signal imposed on said gas discharge lamp.

13. A ballast circuit according to claim 1 wherein said frequency of said second signal is at least five times greater than said frequency of said sinusoidal signal generating means.

14. A ballast circuit according to claim 13 wherein said frequency of said second signal is approximately 635 kHz.

* * * * *